US009056217B2

(12) United States Patent
Kao et al.

(10) Patent No.: US 9,056,217 B2
(45) Date of Patent: Jun. 16, 2015

(54) STATIONARY EXERCISE APPARATUS

(71) Applicant: DYACO INTERNATIONAL INC., Taipei (TW)

(72) Inventors: Kuang-Shiung Kao, Changhua County (TW); Hung-Yi Hu, Changhua County (TW); Min-Ying Lin, Changhua County (TW)

(73) Assignee: DYACO INTERNATIONAL INC., Taipei (TW)

( * ) Notice: Subject to any disclaimer, the term of this patent is extended or adjusted under 35 U.S.C. 154(b) by 158 days.

(21) Appl. No.: 13/759,633

(22) Filed: Feb. 5, 2013

(65) Prior Publication Data

US 2013/0237380 A1 Sep. 12, 2013

(30) Foreign Application Priority Data

Mar. 6, 2012 (TW) ..... 101107540 A

(51) Int. Cl.

| | |
|---|---|
| ***A63B 21/02*** | (2006.01) |
| ***A63B 22/04*** | (2006.01) |
| ***A63B 21/00*** | (2006.01) |
| ***A63B 22/00*** | (2006.01) |
| *A63B 21/22* | (2006.01) |

(52) U.S. Cl.

CPC ..... *A63B 22/04* (2013.01); *A63B 21/15* (2013.01); *A63B 21/225* (2013.01); *A63B 22/0056* (2013.01); *A63B 2022/0053* (2013.01)

(58) Field of Classification Search

CPC ..... A63B 21/225; A63B 22/001; A63B 22/0664; A63B 2022/067; A63B 21/0051; A63B 22/0015

USPC ..... 482/51–65, 1–9

See application file for complete search history.

(56) References Cited

U.S. PATENT DOCUMENTS

| | | | | |
|---|---|---|---|---|
| 3,970,302 | A * | 7/1976 | McFee | 482/53 |
| 4,789,153 | A * | 12/1988 | Brown | 482/111 |
| 5,033,733 | A * | 7/1991 | Findlay | 482/1 |
| 5,116,294 | A * | 5/1992 | Findlay | 482/52 |
| 5,183,448 | A | 2/1993 | Wang | |
| 5,290,211 | A * | 3/1994 | Stearns | 482/53 |
| 5,690,582 | A * | 11/1997 | Ulrich et al. | 482/4 |
| 5,810,696 | A * | 9/1998 | Webb | 482/52 |
| 5,865,712 | A * | 2/1999 | Chang | 482/57 |
| 6,126,573 | A * | 10/2000 | Eschenbach | 482/51 |
| 6,692,410 | B1 * | 2/2004 | Lai | 482/52 |

(Continued)

FOREIGN PATENT DOCUMENTS

| | | |
|---|---|---|
| TW | I252119 | 4/2006 |
| TW | M357991 | 6/2009 |

*Primary Examiner* — Stephen Crow

(74) *Attorney, Agent, or Firm* — Huffman Law Group, PC

(57) ABSTRACT

A stationary exercise apparatus includes a frame, a driving wheel assembly, two treading units, and a flywheel assembly. The flywheel assembly has a driven wheel. The driven wheel and the driving wheel assembly are positioned coaxially and pivotally. The treading units are arranged in a four-link manner and can actuate the driving wheel assembly. The driving wheel assembly drives the driven wheel to rotate at an inertial operating speed higher than the rotation speed of the driving wheel assembly. After being actuated, the stationary exercise apparatus operates continuously because of inertial rotation of the driven wheel. During their operation, pedals of the treading units keep lying on the same horizontal plane to thereby enable the user to tread smoothly and lower the prevalence of sports injuries.

12 Claims, 6 Drawing Sheets

(56) References Cited

U.S. PATENT DOCUMENTS

| | | | | |
|---|---|---|---|---|
| 7,077,789 | B1 * | 7/2006 | Chen | 482/63 |
| 7,708,669 | B2 * | 5/2010 | Rodgers, Jr. | 482/52 |
| 7,935,027 | B2 * | 5/2011 | Graber | 482/51 |
| RE42,699 | E * | 9/2011 | Graber | 482/57 |
| 8,734,298 | B2 * | 5/2014 | Murray | 482/52 |
| 2002/0142889 | A1 * | 10/2002 | Wu | 482/52 |
| 2007/0232465 | A1 * | 10/2007 | Puzey | 482/110 |
| 2009/0170661 | A1 * | 7/2009 | Hsiao | 482/2 |
| 2010/0113223 | A1 * | 5/2010 | Chiles et al. | 482/5 |
| 2010/0190613 | A1 * | 7/2010 | Murray et al. | 482/52 |
| 2012/0015782 | A1 * | 1/2012 | Murray et al. | 482/52 |
| 2014/0206507 | A1 * | 7/2014 | Murray | 482/52 |
| 2014/0243171 | A1 * | 8/2014 | Huang et al. | 482/118 |

* cited by examiner

STATIONARY EXERCISE APPARATUS

BACKGROUND OF THE INVENTION

1. Technical Field

The present invention relates to stationary exercise apparatus, and more particularly, to a stationary exercise apparatus capable of operating continuously after being actuated and driven.

2. Description of Related Art

Due to urbanization and busy lifestyles, it is rather difficult for people nowadays to find appropriate workout facilities and have sufficient workouts. Hence, indoor workouts have become a good choice for keeping the body fit.

Among a variety of indoor workout devices, stationary exercise apparatus is the commonest. A conventional stationary exercise apparatus essentially comprises two pedals. The pedals are each coupled to a bottom base by means of a hydraulic cylinder or a pneumatic cylinder in order to bear a user's treading force. However, it is only when the user treads the pedals continuously and repeatedly that the conventional stationary exercise apparatus can swing up and down repeatedly. As a result, it is likely that the user's knees are overstrained and injured. Another drawback of the prior art is that the tread is not sufficiently smooth. Yet another drawback of the prior art is that, during the tread, it is impossible for the pedals to lie on the same horizontal plane, and in consequence the user is likely to get ankle injury.

SUMMARY OF THE INVENTION

In view of this, the objective of the present invention is to provide a stationary exercise apparatus that operates continuously after being actuated and driven and has pedals lying on the same horizontal plane while operating.

In order to achieve the above objective, the present invention provides a stationary exercise apparatus essentially comprising a frame, a driving wheel assembly, two treading units, and a flywheel assembly. The driving wheel assembly has a driving axle and a driving wheel. The driving axle is disposed pivotally at the frame. The driving wheel is fixed to the driving axle. The treading units each have a transmission element, a first swing bar, a second swing bar, and a pedal. The transmission element is fixed to an end portion of the driving axle and is capable of driving the driving axle to rotate. The first swing bar is connected to the transmission element and is capable of swinging back and forth in the direction toward the ground and the direction away from the ground to thereby drive the transmission element to rotate. The second swing bar and the first swing bar are parallel and spaced apart from each other. The first and second swing bars each have one end pivotally connected to the pedal and the other end pivotally connected to the frame. The flywheel assembly has a driven wheel driven by the driving wheel assembly to start rotating. After being actuated and driven, the driven wheel rotates at an inertial operating speed higher than the rotation speed of the driving wheel assembly.

After being actuated and driven, the stationary exercise apparatus of the present invention operates in such a manner that inertial rotation of the driven wheel causes the treading units to operate continuously. The driven wheel undergoing inertial rotation drives the treading units to swing alternately back and forth in the direction toward the ground and the direction away from the ground and relative to the frame, thereby allowing the user to tread smoothly and reducing the chance that the user gets knee injury. Furthermore, during their operation, the pedals of the treading units always lie on the same horizontal plane to thereby protect the user against ankle strains.

As regards the stationary exercise apparatus of the present invention, the flywheel assembly has a driven wheel assembly and an acceleration wheel assembly. The driven wheel assembly has a driven wheel and a cam. The driven wheel is disposed pivotally at the driving axle. The driven wheel protrudes and extends in a direction away from the driving wheel to form the cam. The acceleration wheel assembly has a wheel axle rod, a small-radius wheel and a large-radius wheel. The wheel axle rod is disposed pivotally at the frame and positioned proximate to the driven wheel. The small-radius wheel is fixed to the wheel axle rod in a way that one end of the wheel axle rod corresponds in position to the driving wheel. The diameter of the small-radius wheel is less than the diameter of the driving wheel. The large-radius wheel is fixed to the wheel axle rodin a way that other end of the wheel axle rod corresponds in position to the cam. The diameter of the large-radius wheel is larger than the diameter of the cam. The driving wheel rotates together with the small-radius wheel synchronously. The large-radius wheel rotates together with the driven wheel synchronously.

The stationary exercise apparatus of the present invention further comprises first and second linkage elements. The first linkage element not only connects the driving wheel and the small-radius wheel but also drives the driving wheel and the small-radius wheel to rotate synchronously. The second linkage element not only connects the large-radius wheel and the cam but also drives the large-radius wheel and the cam to rotate synchronously.

As regards the stationary exercise apparatus of the present invention, the frame has a bottom base and left and right arm portions extending from two opposing sides of the bottom base, respectively, and disposed on two sides of the driven wheel, respectively. The driving wheel assembly has two bushings fixed to the left and right arm portions, respectively. The driving axle is disposed pivotally at the two bushings, such that the driving axle can rotate relative to the frame.

The bushings each have a bearing. The driving axle penetrates the bearings and is fixed thereto, such that the driving axle is disposed pivotally at the bushings.

The driving wheel assembly has a fixing wheel plate fixed to the driving axle. The driving wheel is fixed to the fixing wheel plate, such that the driving wheel and the driving axle can rotate synchronously.

As regards the stationary exercise apparatus of the present invention, the treading units each comprise a connection element and a linkage rod. The connection element is fixed to the first swing bar. The two ends of the linkage rod are pivotally connected to the connection element and the transmission element, respectively. Hence, as soon as the first swing bar swings back and forth in the direction toward the ground and the direction away from the ground, the linkage rod drives the transmission element to rotate and thereby actuate the rotation of the driving wheel assembly.

As regards the stationary exercise apparatus of the present invention, the driven wheel assembly has a bearing. The driving axle penetrates the bearing and is fixed thereto, such that the driven wheel assembly and the driving wheel assembly are coaxial but do not rotate synchronously.

As regards the stationary exercise apparatus of the present invention, the acceleration wheel assembly has a bearing fixed to the frame and a fixing wheel plate fixed to the wheel axle rod. The wheel axle rod penetrates the bearing and is fixed thereto. The large-radius wheel is fixed to the fixing wheel plate. Hence, the large-radius wheel and the wheel axle rod rotate synchronously.

A positioning recess is disposed on a wall of an axial hole of the small-radius wheel. The wheel axle rod has a positioning portion protruding outward and engaged with the positioning recess. Hence, the small-radius wheel and the wheel axle rod can rotate synchronously.

The stationary exercise apparatus of the present invention further comprises two brake blocks spaced apart from each other and disposed on two opposing sides of the driven wheel, respectively. The two brake blocks move from an initial position, at which the two brake blocks are not in contact with the driven wheel but start drawing closer to each other, to a brake position for clamping the driven wheel, thereby stopping the rotation of the driven wheel.

The stationary exercise apparatus of the present invention further comprises a strong magnetic block positioned proximate to a periphery of the driven wheel. The strong magnetic block moves between a position proximal to the driven wheel and a position distal to the driven wheel. As soon as the strong magnetic block approaches the driven wheel made of metal, the magnetic attraction between the driven wheel and the strong magnetic block increases, and thus the driven wheel grinds to a halt.

BRIEF DESCRIPTION OF THE SEVERAL VIEWS OF THE DRAWINGS

The detailed structures and features of the stationary exercise apparatus of the present invention are hereunder illustrated with an embodiment and the accompanying drawings to allow persons skilled in the art to gain insight into the present invention and implement the present invention accordingly.

DETAILED DESCRIPTION OF THE EMBODIMENT OF THE INVENTION

Figure 1:
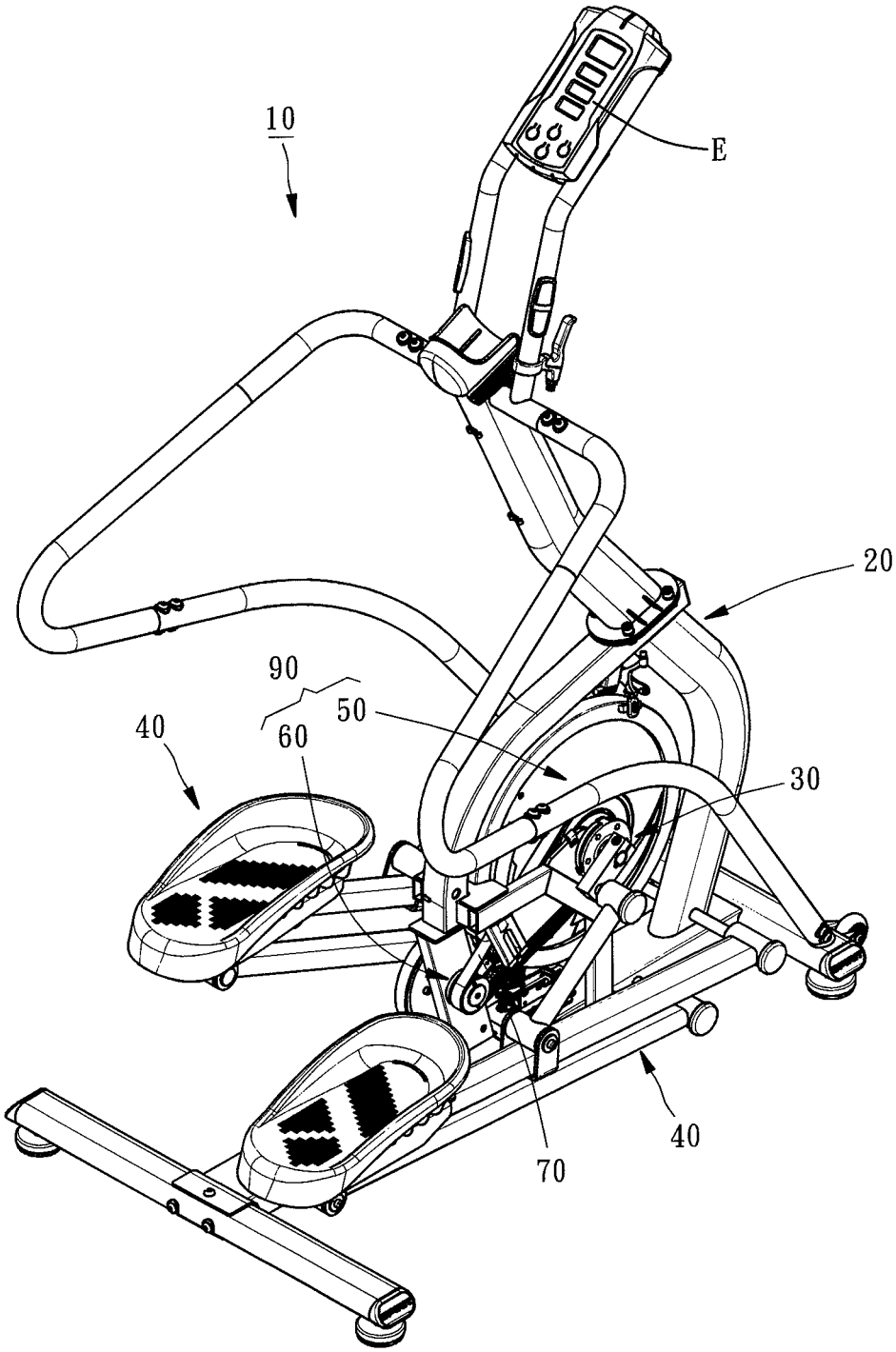
FIG. 1 is a right perspective view of a stationary exercise apparatus according to a preferred embodiment of the present invention.
Figure 2:
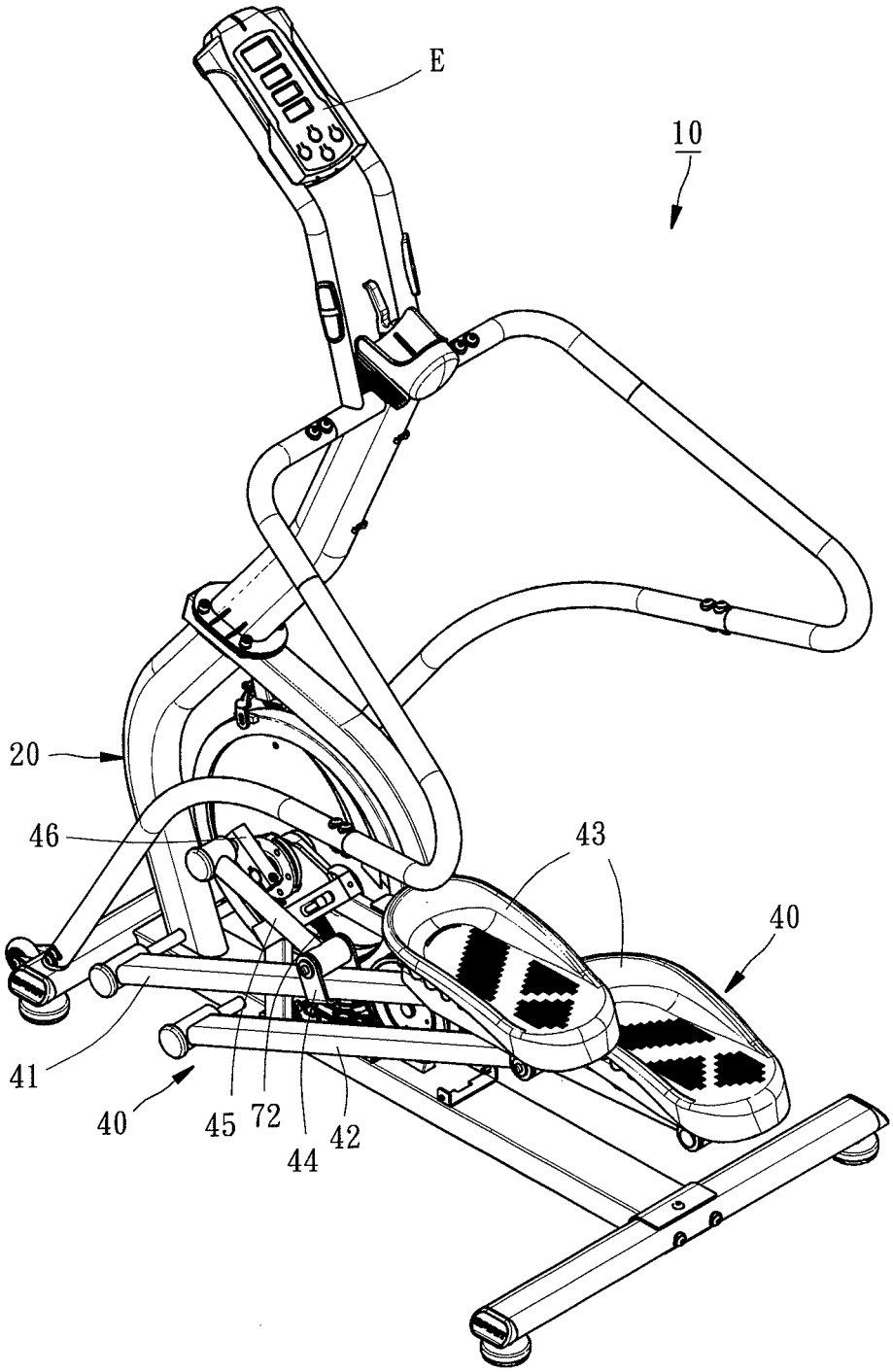
FIG. 2 is a left perspective view of the stationary exercise apparatus according to the preferred embodiment of the present invention.
Figure 3:
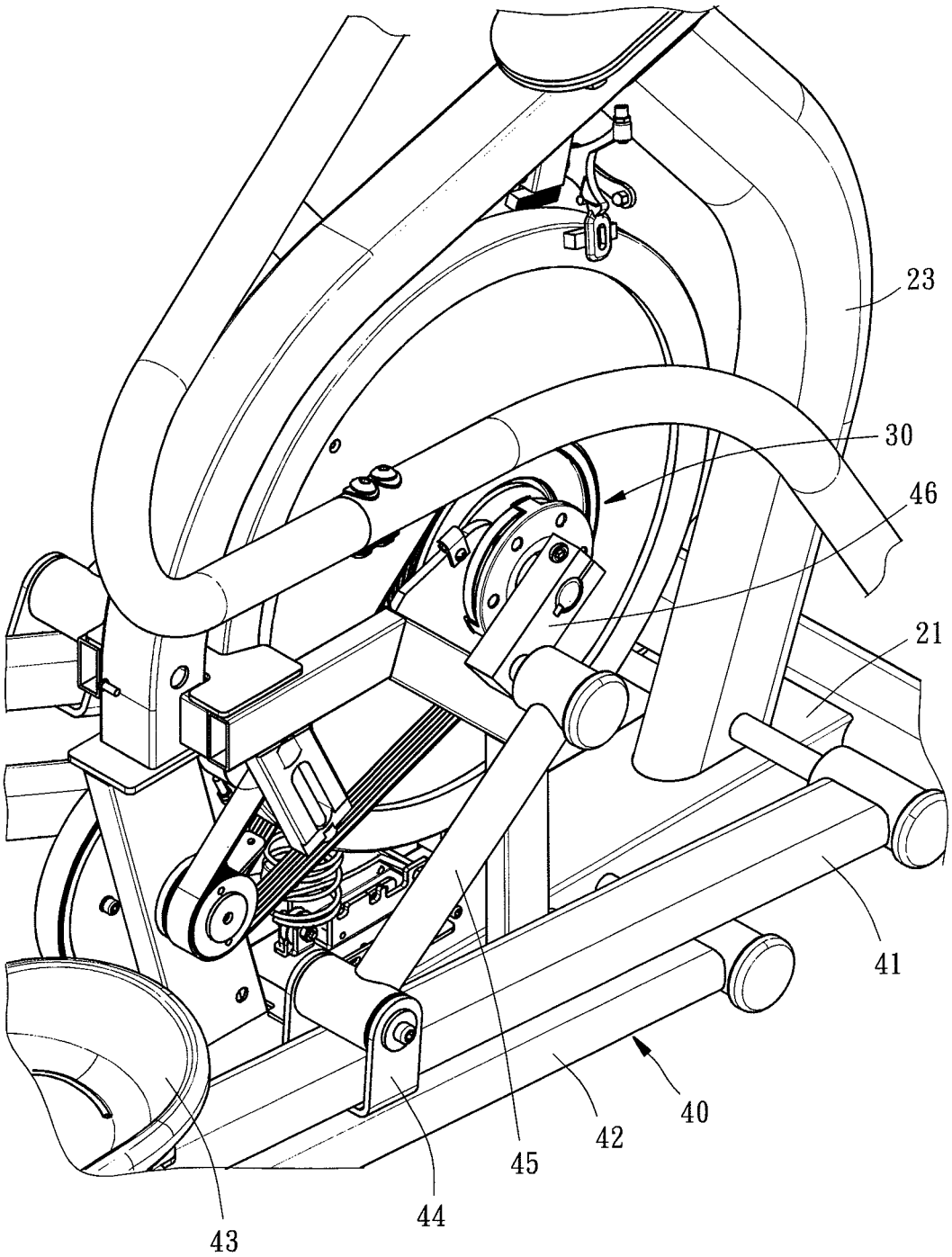
FIG. 3 is a right partial enlarged perspective view of the stationary exercise apparatus according to the preferred embodiment of the present invention.
Figure 4:
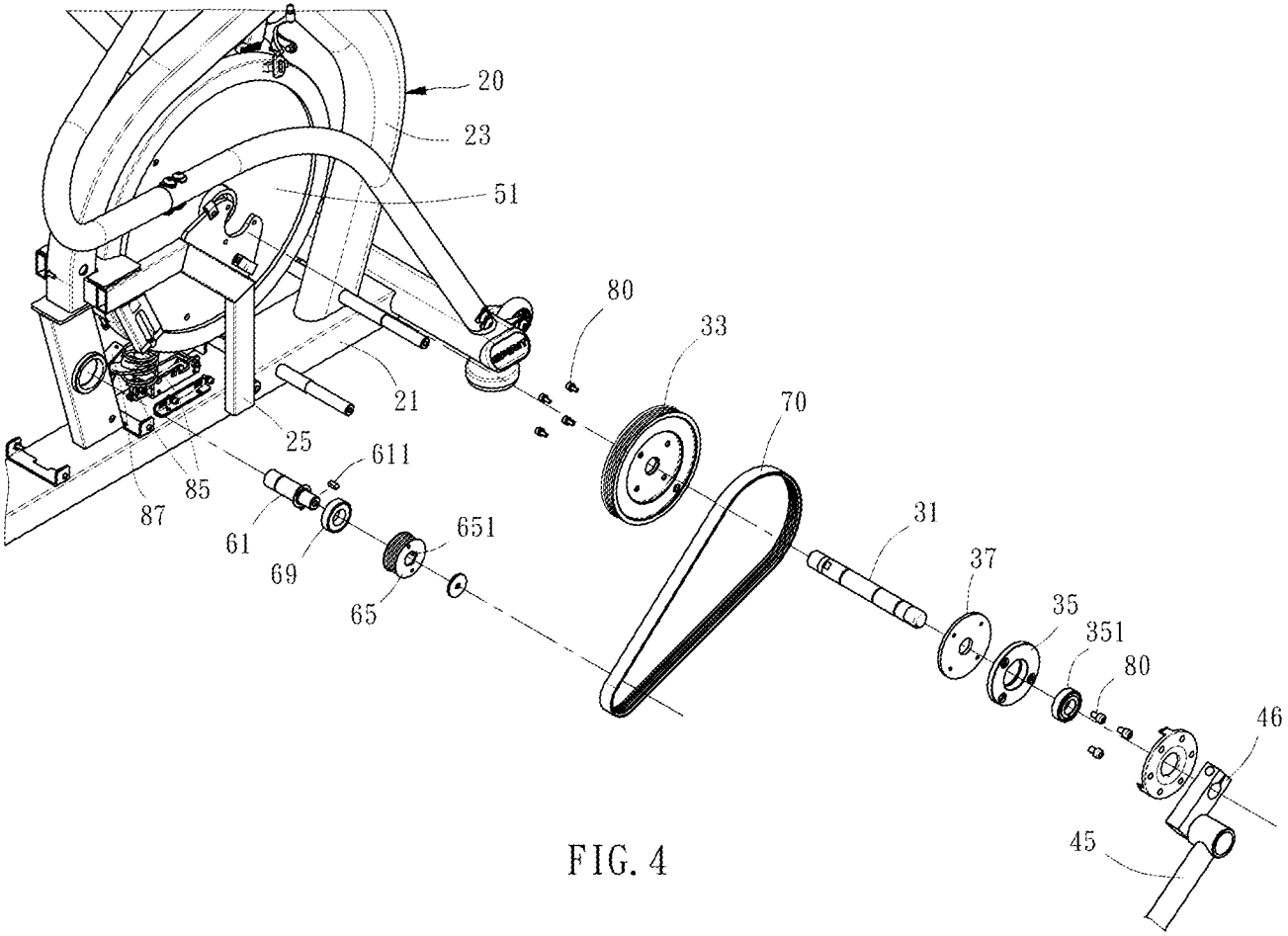
FIG. 4 is a right partial exploded view of the stationary exercise apparatus according to the preferred embodiment of the present invention.
Figure 5:
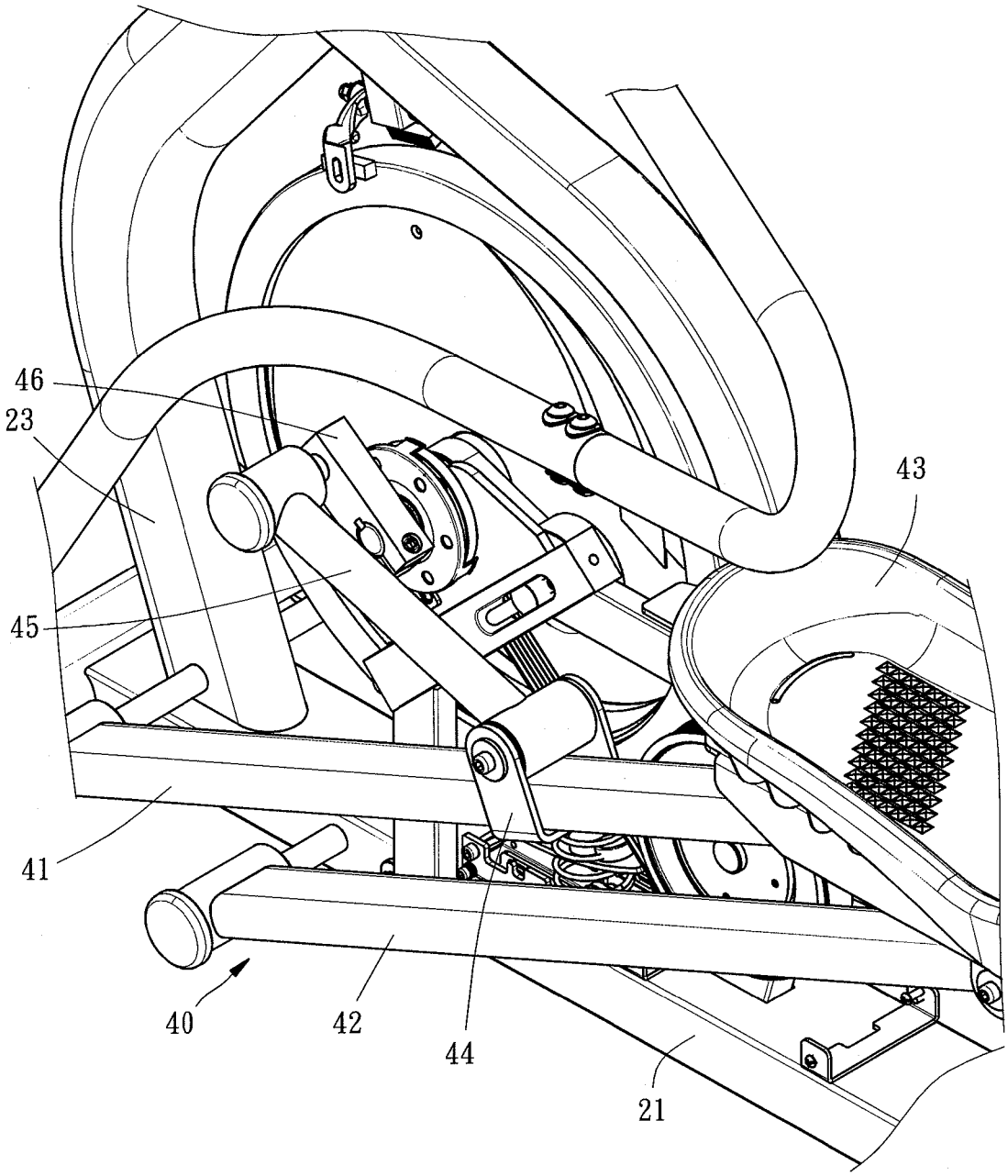
FIG. 5 is a left partial enlarged perspective view of the stationary exercise apparatus according to the preferred embodiment of the present invention.
Figure 6:
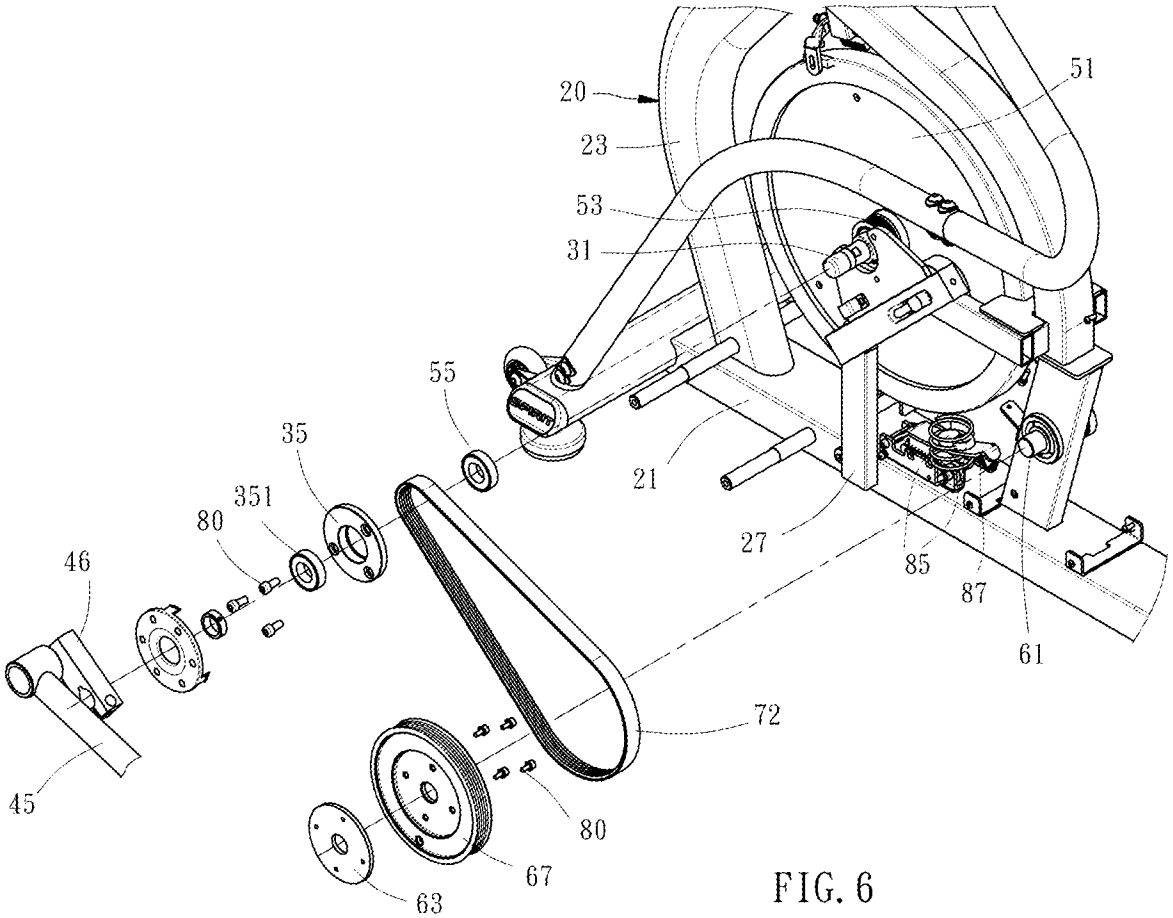
FIG. 6 is a left partial exploded view of the stationary exercise apparatus according to the preferred embodiment of the present invention.

The present invention is hereunder illustrated with a specific embodiment in conjunction with the accompanying drawings, in which:

FIG. 1 is a right perspective view of a stationary exercise apparatus according to a preferred embodiment of the present invention;

FIG. 2 is a left perspective view of the stationary exercise apparatus according to the preferred embodiment of the present invention;

FIG. 3 is a right partial enlarged perspective view of the stationary exercise apparatus according to the preferred embodiment of the present invention;

FIG. 4 is a right partial exploded view of the stationary exercise apparatus according to the preferred embodiment of the present invention;

FIG. 5 is a left partial enlarged perspective view of the stationary exercise apparatus according to the preferred embodiment of the present invention; and FIG. 6 is a left partial exploded view of the stationary exercise apparatus according to the preferred embodiment of the present invention.

Direction-related adjectives used herein, such as "front," "rear," "up," "down," "left," and "right" should be interpreted by making reference to the accompany drawings of the present invention.

Referring to FIG. 1 and FIG. 2, in a preferred embodiment of the present invention, a stationary exercise apparatus 10 essentially comprises a frame 20, a driving wheel assembly 30, two treading units 40, and a flywheel assembly 90.

Referring to FIG. 4 and FIG. 6, the frame 20 comprises a bottom base 21, an upright support 23, and left and right arm portions 25, 27. The upright support 23 extends upward from a point in the vicinity of the front end of the bottom base 21. The left and right arm portions 25, 27 extend upward from two opposing lateral sides of the bottom base 21, respectively.

Referring to FIG. 4 and FIG. 6, the driving wheel assembly 30 has a driving axle 31, a driving wheel 33, two bushings 35, and a fixing wheel plate 37. The two bushings 35 are fixed to left and right arm portions 25, 27 of the frame 20 by means of a plurality of fastening elements 80, such as bolts, respectively. A bearing 351 is disposed on an axial hole inner wall of each of the bushings 35. The driving axle 31 penetrates the bearings 351 and is fixed to the inner rings of the bearings 351, respectively, to thereby be rotatable relative to the frame 20 and be disposed at the frame 20. The fixing wheel plate 37 is fixed to the driving axle 31 by an appropriate means, including but not limited to welding. The driving wheel 33 is fixed to the fixing wheel plate 37 by the plurality of fastening elements 80, such as bolts, and thereby rotates together with the driving axle 31 synchronously. The driving wheel 33 is, for example, a pulley, a sprocket, or a gear.

Referring to FIG. 1, FIG. 2, FIG. 3, and FIG. 5, the treading units 40 are disposed on two opposing lateral sides of the driving wheel assembly 30, each have a first swing bar 41, a second swing bar 42 which is parallel to and spaced apart from the first swing bar 41, a pedal 43, a connection element 44 fixed to the first swing bar 41, a linkage rod 45, and a transmission element 46.

The first and second swing bars 41, 42 each have one end fixed to the upright support 23 and the bottom base 21, respectively, and the other end fixed to the pedals 43, and lie on the same axis. Hence, the first and second swing bars 41, 42 swing synchronously. During the swing, the pedals 43 lie on the same horizontal plane.

The two ends of the linkage rod 45 are pivotally connected to the connection element 44 and one end of the transmission element 46, respectively. The other end of the transmission element 46 is fixed to the driving axle 31. Hence, as soon as a user begins to tread the pedal 43 and thereby causes the first and second swing bars 41, 42 to swing back and forth in the direction toward the ground and the direction away from the ground, the linkage rod 45 drives the transmission element 46 to rotate, thereby actuating the driving wheel assembly 30.

In this embodiment, the flywheel assembly 90 comprises a driven wheel assembly 50 and an acceleration wheel assembly 60. Referring to FIG. 4 and FIG. 6, the driven wheel assembly 50 has a driven wheel 51, a cam 53, and a bearing 55. The driven wheel 51 and the driving wheel assembly 30 are coaxially disposed between the two treading units 40. The driven wheel 51 protrudes and extends leftward, that is, in a direction away from the driving wheel, to form the cam 53 integrally. The bearing 55 is disposed on an axial hole inner wall of the cam 53. Hence, the driving axle 31 penetrates the bearing 55 and is fixed to the inner ring of the bearing 55, such that the driven wheel assembly 50 and the driving wheel assembly 30 are coaxial in configuration but do not rotate synchronously.

Referring to FIG. 4 and FIG. 6, the acceleration wheel assembly 60 comprises a wheel axle rod 61, a fixing wheel plate 63, a small-radius wheel 65, and a large-radius wheel 67. The wheel axle rod 61 is disposed pivotally, by means of a bearing 69, at a position on the frame 20, wherein the position on the frame 20 is in the vicinity of the driven wheel 51. The diameter of the small-radius wheel 65 is less than the diameter of the driving wheel 33. The small-radius wheel 65 rotates together with the driving wheel 33 synchronously. The diameter of the large-radius wheel 67 is larger than the diameter of the cam 53. The large-radius wheel 67 rotates together with the cam 53 synchronously.

The wheel axle rod 61 has a positioning portion 611 protruding outward. A positioning recess 651 which dents centrally is disposed on the wall of the axial hole of the small-radius wheel 65 and engaged with the positioning portion 611, such that the small-radius wheel 65 is fixed to the wheel axle rod 61 to thereby rotate together with the wheel axle rod 61 synchronously.

The fixing wheel plate 63 is fixed to the wheel axle rod 61 by an appropriate means, including but not limited to welding. The large-radius wheel 67 is fixed to the fixing wheel plate 63 by means of the plurality of fastening elements 80, such as bolts, to thereby rotate together with the wheel axle rod 61 synchronously. The small-radius wheel 65 and the large-radius wheel 67 are, for example, pulleys, sprockets, or gears.

In this embodiment, the driving wheel 33 and the small-radius wheel 65 are connected by a first linkage element 70. For example, the first linkage element 70 is disposed between the driving wheel 33 and the small-radius wheel 65. Hence, as soon as the transmission element 46 of the treading units 40 actuates the rotation of the driving wheel 33 of the driving wheel assembly 30, the first linkage element 70 drives the small-radius wheel 65 of the acceleration wheel assembly 60 to rotate together with the driving wheel 33 synchronously. Since the diameter of the small-radius wheel 65 is less than the diameter of the driving wheel 33, the rotation of the small-radius wheel 65 accelerates.

Likewise, the large-radius wheel 67 and the cam 53 are connected by a second linkage element 72. For instance, the second linkage element 72 is disposed between the large-radius wheel 67 and the cam 53. Hence, as soon as the small-radius wheel 65 is driven by the driving wheel 33 to rotate with angular acceleration, not only both the large-radius wheel 67 and the small-radius wheel 65 rotate with angular acceleration synchronously, but the second linkage element 70 also drives the cam 53 to rotate synchronously. Since the diameter of the large-radius wheel 67 is larger than the diameter of the cam 53, the cam 53 rotates with angular acceleration, and in consequence the driven wheel 51 continues with its inertial rotation. The first and second linkage elements 70, 72 correspond in configuration to the driving wheel 33, the small-radius wheel 65, and the large-radius wheel 67 and therefore are belts or chains.

Referring to FIG. 1 and FIG. 2, in practice, as soon as the user treads the pedal 43 alternately to cause the first and second swing bars 41, 42 to swing back and forth in the direction toward the ground and the direction away from the ground, rotation of the driving axle 31 relative to the frame 20 is actuated. With the driving wheel 33 being fixed to the driving axle 31 through the fixing wheel plate 37, the driving wheel 33 and the driving axle 31 rotate synchronously. With the driven wheel 51 being disposed pivotally at the driving axle 31 through the bearing 55, the driving axle 31 does not actuate rotation of the driven wheel 51. After the driving wheel 33 has started rotating, the driving wheel 33 actuates synchronous rotation of the small-radius wheel 65 of the acceleration wheel assembly 30 through the first linkage element 70. With the small-radius wheel 65 being smaller than the driving wheel 33, the small-radius wheel 65 rotates with angular acceleration to thereby bring about a first-stage acceleration effect. Not only the small-radius wheel 65 rotates together with the large-radius wheel 67 at an angular acceleration synchronously by means of the wheel axle rod 61, but the small-radius wheel 65 also drives the cam 53 to rotate by means of the second linkage element 72 to thereby drive the driven wheel 51 to rotate synchronously. With the cam 53 being smaller than the large-radius wheel 67, the cam 53 rotates with angular acceleration to thereby bring about a second-stage acceleration effect. Hence, the driven wheel 51 continues with its inertial rotation to thereby enable the user to tread more smoothly.

After being actuated and driven, the stationary exercise apparatus 10 of the present invention operates in such a manner that inertial rotation of the driven wheel 51 causes the treading units 40 to operate continuously to thereby prevent the user's knees from being overstrained and reduce the chance of knee injuries. Furthermore, during their operation, the pedals 43 of the treading units 40 always lie on the same horizontal plane to thereby protect the user against ankle strains.

Referring to FIGS. 1, 2, 3, 5, during its manufacturing process, the stationary exercise apparatus 10 of the present invention can be equipped with two brake blocks 81 spaced apart from each other and disposed on the two opposing sides of the driven wheel 51, respectively. A control element 83 disposed at the frame 20 controls the two brake blocks 81 to draw closer to each other or to pull away from each other. Specifically speaking, as soon as the user presses the control element 83, the two brake blocks 81 move from an initial position, at which the two brake blocks 81 are not in contact with the driven wheel 51 but start drawing closer to each other, to a brake position for clamping the driven wheel 51. As soon as the user stops pressing the control element 83, the two brake blocks 81 go back to the initial position while pulling away from each other. Hence, the user can pause the inertial rotation of the driven wheel 51 as needed and at any time.

Referring to FIG. 4 and FIG. 6, during its manufacturing process, the stationary exercise apparatus 10 of the present invention can be equipped with a strong magnetic block 85 which is exemplified in the drawings by two strong magnetic blocks 85. The two strong magnetic blocks 85 are disposed on a platform 87 capable of rotating pivotally relative to the bottom base 21 and swinging up and down and positioned proximate to a periphery of the driven wheel 51. The operation of the platform 87 is controlled by a dashboard E (shown in FIG. 1), for example. As soon as the platform 87 swings upward and approaches the driven wheel 51, the magnetic attraction between the driven wheel 51 and the strong magnetic blocks 85 increases because the driven wheel 51 is made of metal, and thus the driven wheel 51 grinds to a halt. Conversely, as soon as the platform 87 returns to the initial position distal to the driven wheel 51, the magnetic attraction between the driven wheel 51 and the strong magnetic blocks 85 decreases, and thus the driven wheel 51 continues with its inertial rotation. Hence, the user can pause the inertial rotation of the driven wheel 51 or reduce the rotation speed of the driven wheel 51 as needed and at any time.

In conclusion, after being actuated, the stationary exercise apparatus 10 of the present invention operates continuously because of inertial rotation of the driven wheel 51. During their operation, the pedals 43 of the treading units 40 keep lying on the same horizontal plane, and thus the user can tread smoothly to thereby lower the prevalence of sports injuries. Furthermore, with the two brake blocks 81 and the strong magnetic blocks 85, the user can better control the driven wheel 51 to continue with its rotation or reduce the rotation speed of the driven wheel 51.

What is claimed is:

1. A stationary exercise apparatus, comprising:

a frame;

a driving wheel assembly having a driving axle disposed pivotally at the frame and a driving wheel fixed to the driving axle;

two treading units disposed on two opposing sides of the driving wheel assembly, respectively, and each having a transmission element fixed to an end portion of the driving axle and capable of driving the driving wheel to rotate, a first swing bar having a medially connected linkage rod connected to the transmission element and capable of swinging back and forth in the direction toward the ground and the direction away from the ground to thereby drive the transmission element to rotate, a second swing bar parallel to and spaced apart from the first swing bar, and a pedal, the first and second swing bars having an end pivotally connected to the pedal and another end pivotally connected to the frame; and a flywheel assembly having a driven wheel driven by the driving wheel assembly to start rotating at an inertial operating speed higher than a rotation speed of the driving wheel assembly, such that the driven wheel rotating at the inertial operating speed drives the treading units to swing alternately back and forth in the direction toward the ground and the direction away from the ground and relative to the frame.

2. The stationary exercise apparatus of claim 1, wherein the flywheel assembly comprises:

a driven wheel assembly having the driven wheel disposed pivotally at the driving axle and a cam protruding from the driven wheel and extending in a direction away from the driving wheel; and an acceleration wheel assembly having a wheel axle rod disposed pivotally at the frame and positioned proximate to the driven wheel, a small-radius wheel fixed to a driving wheel-facing end of the wheel axle rod and having a smaller diameter than the driving wheel, and a large-radius wheel fixed to another cam-facing end of the wheel axle rod and having a larger diameter than the cam, wherein the driving wheel and the small-radius wheel rotate synchronously, wherein the large-radius wheel and the cam rotate synchronously.

3. The stationary exercise apparatus of claim 2, further comprising:

a first linkage element disposed between the driving wheel and the small-radius wheel to thereby drive the driving wheel and the small-radius wheel to rotate synchronously; and a second linkage element disposed between the large-radius wheel and the cam to thereby drive the large-radius wheel and the cam to rotate synchronously.

4. The stationary exercise apparatus of claim 1, wherein the frame has a bottom base and left and right arm portions extending from two opposing sides of the bottom base, respectively, and disposed on two sides of the driven wheel, respectively, wherein the driving wheel assembly has two bushings fixed to the left and right arm portions, respectively, wherein the driving axle is disposed pivotally at the two bushings.

5. The stationary exercise apparatus of claim 4, wherein the bushings of the driving wheel assembly each have a bearing, and the driving axle penetrates the bearings and is fixed thereto.

6. The stationary exercise apparatus of claim 1, wherein the driving wheel assembly has a fixing wheel plate fixed to the driving axle, and the driving wheel is fixed to the fixing wheel plate.

7. The stationary exercise apparatus of claim 1, wherein the treading units each have a connection element fixed to the first swing bar and a linkage rod having two ends pivotally connected to the connection element and the transmission element, respectively.

8. The stationary exercise apparatus of claim 1, wherein the driven wheel assembly has a bearing, and the driving axle penetrates the bearing and is fixed thereto.

9. The stationary exercise apparatus of claim 2, wherein the acceleration wheel assembly has a bearing fixed to the frame and a fixing wheel plate fixed to the wheel axle rod, the wheel axle rod penetrating the bearing and being fixed thereto, wherein the large-radius wheel is fixed to the fixing wheel plate.

10. The stationary exercise apparatus of claim 2, wherein a positioning recess is disposed on a wall of an axial hole of a small-radius wheel of the acceleration wheel assembly, and the wheel axle rod has a positioning portion protruding outward and engaged with the positioning recess.

11. The stationary exercise apparatus of claim 1, further comprising two brake blocks spaced apart from each other and disposed on two opposing sides of the driven wheel, respectively, the two brake blocks moving from an initial position, at which the two brake blocks are not in contact with the driven wheel but start drawing closer to each other, to a brake position for clamping the driven wheel.

12. The stationary exercise apparatus of claim 1, further comprising a strong magnetic block positioned proximate to a periphery of the driven wheel and movable between a position proximal to the driven wheel and a position distal to the driven wheel.

* * * * *